United States Patent [19]

Ivanov et al.

[11] 4,227,828

[45] Oct. 14, 1980

[54] BUILDING BERTH VESSEL SUPPORT AND HANDLING SYSTEM

[76] Inventors: Jury P. Ivanov, Grazhdansky prospekt, 92/2, kv. 1; Evgeny A. Evstafiev, ulitsa Karpinskogo, 31, korpus 1, kv. 139, both of Leningrad, U.S.S.R.

[21] Appl. No.: 911,537

[22] Filed: Jun. 1, 1978

[30] Foreign Application Priority Data

Jun. 1, 1977 [SU] U.S.S.R. ..... 2492490[I]

[51] Int. Cl.[2] ..... B63C 5/05

[52] U.S. Cl. ..... 405/1; 114/65 R; 405/7

[58] Field of Search ..... 114/65 R, 77 R; 193/35 R, 35 SS, 35 MD, 42; 405/1, 3, 4, 7

[56] References Cited

U.S. PATENT DOCUMENTS

| | | | |
|---|---|---|---|
| 2,567,335 | 9/1951 | Hebert | 193/42 X |
| 3,265,186 | 8/1966 | Burton | 193/35 MD X |
| 3,721,096 | 3/1973 | Deckert, Jr. | 405/7 |
| 4,068,753 | 1/1978 | Jarman | 193/35 MD X |

OTHER PUBLICATIONS

M. K. Glozman and A. L. Vasiliev, "Technological Aspects of Hull Design", Sudostroeniye Publishers, Leningrad, 1971.

A. K. Syrkov, "Modern Shipyards", Sudostroyeniye Publishers, Leningrad, 1976.

*Primary Examiner*—Sherman D. Basinger

*Attorney, Agent, or Firm*—Fleit & Jacobson

[57] ABSTRACT

According to the invention, the building berth vessel support and handling system comprises longitudinal and transverse rows of keel blocks which serve to support a vessel as she changes position. Each keel block, in turn, comprises a support, a lifting mechanism installed in the support, and a housing accommodating a support pad which is shaped as a body of revolution, for example, a cylinder, and rests on the lifting mechanism.

9 Claims, 4 Drawing Figures

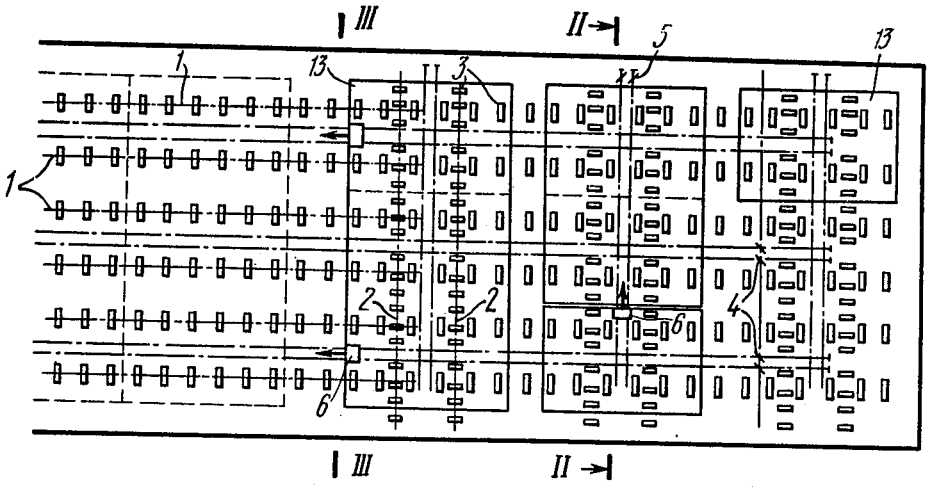
FIG. 1
FIG. 2
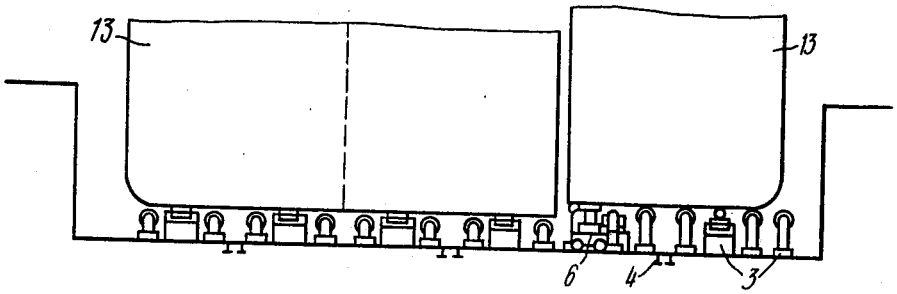

BUILDING BERTH VESSEL SUPPORT AND HANDLING SYSTEM

FIELD OF THE INVENTION

The present invention relates to shipbuilding and, more particularly, to means for supporting and moving vessels on building sites, such as horizontal berths, dry docks, etc.

The invention is best suited for the handling of parallel middlebodies, as well as hulls of tankers, combination OO, OB, OBO, and PrOBO carriers, bulk carriers and LNG and LPG tankers. The deadweight tonnage of such ships is expected to be in the range of 20,000 to 360,000 tons.

BACKGROUND OF THE INVENTION

It is customary in modern practice to use stationary keel blocks to support a vessel on a building berth. The keel blocks are arranged in longitudinal rows and spaced at a certain distance from one another, depending on the load distribution (cf. A. K. Syrkov, Sovremennye sudostroitelnye verfi/Modern Shipyards/, Sudostroyeniye Publishers, Leningrad, 1976).

Each keel block comprises a support and a lifting mechanism installed in the support and bearing a housing which accommodates a support pad (cf. M. K. Glozman et al., Technologichnost konstruktsiy korpusa sudna/Technological Aspects of Hull Designs/, Sudostroyeniye Publishers, Leningrad, 1971). The lifting mechanism may be hydraulic or of any other type.

The known systems for supporting and handling vessels or parts of vessels on a building berth are disadvantageous in that they necessitate the use of hauling carriages or trains composed of such carriages, which are rolled in under the bottom of a vessel resting on keel blocks. The carriages are provided with jacks which lift the vessel from the keel blocks so that she is supported by the carriages and can thus be moved to a desired location.

Independent hauling trains are normally used to transfer a vessel in the longitudinal and transverse directions with respect to the berth axis.

The above-mentioned disadvantage is all the more pronounced in the case of progressive-sectional assembly of hulls which makes it necessary to move hull parts in both the longitudinal and transverse directions; the great number of assembly stations calls for a corresponding number of handling operations and means to carry them out.

For example, when side tank modules have to be moved in a dry dock, it takes two self-propelled trains to haul them in the longitudinal direction and two more trains to carry them in the transverse direction, while in the course of assembly the modules rest on a system of keel blocks.

The provision of separate keel block and hauling carriage systems for supporting and handling a vessel on a building berth requires considerable capital investment.

SUMMARY OF THE INVENTION

It is an object of the present invention to make it possible to move a hull about a building berth without using auxiliary means of transportation.

It is another object of the invention to provide a building berth vessel support and handling system which would serve both to support and transport vessels.

The foregoing and other objects of the invention are attained by providing a building berth vessel support and handling system comprising longitudinal rows of keel blocks to support a vessel, each keel block comprising, in turn, a support and a lifting mechanism installed in the support and carrying a housing accommodating a support pad, which system is characterized, according to the invention, in that it further includes transverse rows of keel blocks similar to those of the longitudinal rows, and in that the support pad of each keel block is a body of revolution arranged in the housing so that it is rotatable about its rotation axis which extends at a perpendicular to the direction of the vessel's movement and in a plane parallel to that of the vessel's bottom.

The support pad may be shaped as a cylinder and provided with an elastic coating.

The system according to the invention serves both to support and transport a vessel in the course of construction, whereby it is possible to dispense with costly conventional transportation means and speed up assembly operations.

BRIEF DESCRIPTION OF THE ACCOMPANYING DRAWINGS

The invention will now be explained in greater detail with reference to a specific embodiment thereof, taken in conjunction with the accompanying drawings, wherein:

FIG. 1 is a plan view of a building berth vessel support and handling system in accordance with the invention;

FIG. 2 is a section taken on line II—II of FIG. 1;

DETAILED DESCRIPTION OF THE INVENTION

Figure 3:
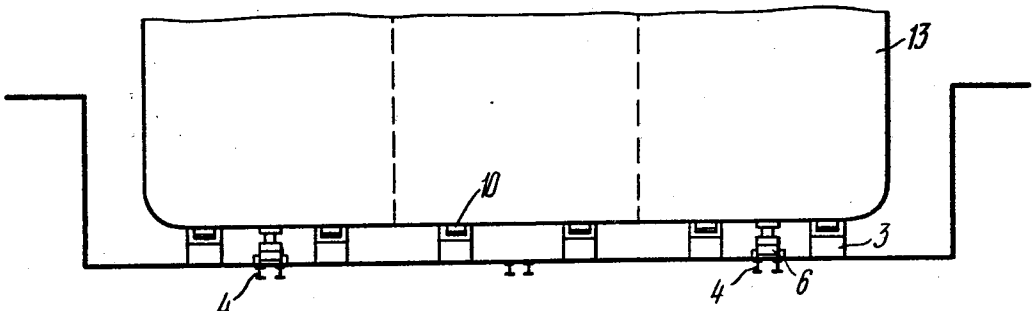
FIG. 3 is a section taken on line III—III of FIG. 1.

Referring to the attached drawings, the building berth vessel support and handling system according to the invention comprises longitudinal rows 1 (FIG. 1) and transverse rows 2 of keel blocks 3 arranged on a building berth. The spacing of the keel blocks 3 is determined by the load they have to carry.

The rows 1 are not necessarily parallel, and the rows 2 are not necessarily transverse to the axis of the building berth, their arrangement being determined by specific assembly requirements.

Tracks 4 (FIGS. 2 and 3) are laid between the longitudinal rows 1, and tracks 5 are laid between the transverse rows 2.

Hauling means 6 are set on the tracks 4 and 5.

Each keel block 3 (FIG. 4) comprises a support 7 placed on the building berth. Built into the support 7 is a lifting mechanism 8, for example, a hydraulic jack. The lifting mechanism 8 serves as a base for a housing 9 which accommodates a support pad 10. The latter is a body of revolution, for example, a cylinder, rotatable about a rotation axis 11 extending at a perpendicular to the direction of the vessel's movement in a plane parallel to that of the vessel's bottom.

To protect the hull against damage the support pad 10 is provided with an elastic coating 12, made for example, of rubber.

To provide a clear-cut example, FIGS. 1, 2 and 3 refer to a module 13 of a parallel middlebody.

The parallel middlebody assembled from modules 13 is placed on support pads 10 (FIG. 3) shaped as cylinder rollers.

Figure 4:
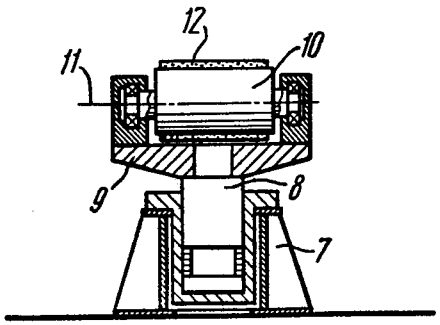
FIG. 4 is a general view of a keel block in accordance with the invention.

To move a module 13 in the transverse direction, the hauling means 6 haul it along the transverse rows 2 of keel blocks 3 on the rollers 10 rotating about the axes 11 (FIG. 4). As this takes place, the rollers 10 are lifted by the lifting mechanisms 8 to the uppermost position so that the module 13 can freely traverse the longitudinal rows 1 of keel blocks 3 (FIGS. 1 and 2).

As the module 13 reaches its destination, the lifting mechanisms 8 lower the rollers 10 of the keel blocks 3 of the transverse row 2 to the lowermost position to put the module 13 on the rollers 10 of the longitudinal row 1 (FIGS. 1 and 3) of keel blocks 3. The module 13 is then moved in the longitudinal direction to be joined to the already assembled part of the parallel middlebody.

The provision of longitudinal and transverse rows of keel blocks, as well as of rollers and hydraulic jacks to vary the position of the rollers in the vertical plane enables the system both to hold in place and transport hulls and their components without resorting to hauling carriages and thus considerably curtails the capital investment involved.

What is claimed is:

1. A building berth vessel support and handling system comprising:

a first plurality of keel blocks arranged in longitudinal rows for supporting a vessel as the vessel is moved in a longitudinal direction, said first plurality of keel blocks having support pads for supporting the vessel, said support pads being movable between raised and lowered positions;

a second plurality of keel blocks arranged in transverse rows for supporting a vessel as the vessel is moved in a transverse direction, said second plurality of keel blocks having support pads for supporting the vessel, said support pads being movable between first and second positions, the first positions being lower than the raised positions and the second positions being higher than the lowered positions of said support pads of said first plurality of keel blocks; and each of said first and second plurality of keel blocks comprising:

a support positionable on a floor of a building berth;

a lifting mechanism installed in said support for raising and lowering said support pad;

a housing resting on said lifting mechanism and accommodating said support pad, said housing being movable by said lifting mechanism to raise and lower said support pad, the support pads of said first plurality of keel blocks being positionable in said raised positions, and the support pads of said second plurality of keel blocks being positionable in said first lower positions to facilitate longitudinal movement of a vessel, and the support pads of said first plurality of keel blocks being positionable in said lowered positions, and the support pads of said second plurality of keel blocks being positionable in said second higher positions to facilitate transverse movement of a vessel.

2. A system as claimed in claim 1, wherein each of said support pads is shaped as a body of revolution whose axis of rotation extends at a perpendicular to the direction of the vessel's movement in a plane parallel to that of the vessel's bottom.

3. A system as claimed in claim 1 or 2, wherein each of said support pads is shaped as a cylinder.

4. A system as claimed in claim 1 or 2, wherein each of said support pads is provided with an elastic coating.

5. A system as claimed in claim 1 or 2, further comprising a plurality of tracks arranged between said longitudinal rows for guiding means for hauling a vessel.

6. A system as claimed in claim 5, further comprising a plurality of tracks arranged between said transverse rows for guiding means for hauling a vessel.

7. A system as claimed in claim 1, wherein said first and said second plurality of keel blocks are movable into positions in which the support pads are located at the same level so that a vessel can be transferred from one to the other plurality of keel blocks.

8. A building berth vessel support and handling system comprising:

a first plurality of stationary keel blocks arranged in longitudinal rows and having support pads for supporting a vessel or its component parts during movement in a longitudinal direction;

a second plurality of stationary keel blocks arranged in transverse rows and having support pads for supporting a vessel or its component parts during movement in a transverse direction;

the support pads of at least one of said first and said second plurality of keel blocks being movable between raised and lowered positions, said movable support pads in the raised position supporting the vessel, the support pads of the other of said first and said second plurality of keel blocks supporting the vessel when the movable support pads are in the lowered position;

each of said keel blocks with movable support pads comprising:

a stationary support positionable on a floor of a building berth;

a lifting mechanism installed in said support for raising and lowering said movable support pad;

a housing resting on said lifting mechanism and accommodating said movable support pad in such manner that movement of said housing by said lifting mechanism raises and lowers said movable support pad.

9. A building berth vessel support and handling system comprising:

a first plurality of keel blocks arranged stationary in longitudinal rows for supporting an element, such as a vessel or parts thereof, during movement in a longitudinal direction, said first plurality of keel blocks having support pads for supporting the element, said support pads being movable between raised and lowered positions;

a second plurality of keel blocks arranged stationary in transverse rows for supporting the element during movement in a transverse direction, said second plurality of keel blocks having support pads for supporting the element, said support pads being movable between raised and lowered positions, the same as portions of said support pads of said first plurality of keel blocks, each of said first and second plurality of keel blocks comprising:

a support positionable stationary on the floor of a building berth;

a lifting mechanism installed in said support for raising and lowering said support pad;

a housing resting on said lifting mechanism and accommodating said support pad, said housing being movable by said lifting mechanism to raise and lower said support pad, the support pads of said first plurality of keel blocks being positionable in said raised positions, and the support pads of said second plurality of keel blocks being positionable in said lowered positions to facilitate longitudinal movement of the element, and the support pads of said first plurality of keel blocks being positionable in said lowered positions, and the support pads of said second plurality of keel blocks being positionable in said raised positions to facilitate transverse movement of the element.

* * * * *